US007204680B2

(12) United States Patent
Park

(10) Patent No.: US 7,204,680 B2
(45) Date of Patent: Apr. 17, 2007

(54) OIL SUPPLY DEVICE OF SCROLL COMPRESSOR

(75) Inventor: Ki-Won Park, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 15 days.

(21) Appl. No.: 11/013,443

(22) Filed: Dec. 17, 2004

(65) Prior Publication Data

US 2005/0135957 A1 Jun. 23, 2005

(30) Foreign Application Priority Data

Dec. 20, 2003 (KR) ..... 10-2003-0094282

(51) Int. Cl.
*F03C 2/00* (2006.01)
*F04C 18/00* (2006.01)

(52) U.S. Cl. ..... 418/55.6; 418/55.1; 418/94; 184/6.18

(58) Field of Classification Search ..... 418/55.1–55.6, 418/57, 94; 184/6.16, 618; 464/102
See application file for complete search history.

(56) References Cited

U.S. PATENT DOCUMENTS 6,413,060 B1 * 7/2002 Tarng et al. ..... 418/55.6
6,776,593 B1 * 8/2004 Cho ..... 418/55.3

FOREIGN PATENT DOCUMENTS

| | | | | |
|---|---|---|---|---|
| JP | 03067080 A | * | 3/1991 | ..... 418/55.6 |
| JP | 04063984 A | * | 2/1992 | ..... 418/55.6 |
| JP | 05240175 A | * | 9/1993 | ..... 418/55.6 |
| JP | 09158862 A | * | 6/1997 | ..... 418/55.6 |
| KR | 2001109821 A | * | 12/2001 | ..... 418/55.6 |
| KR | 10-2005-0043485 | | 5/2005 | |

* cited by examiner

*Primary Examiner*—Theresa Trieu
(74) *Attorney, Agent, or Firm*—Birch, Stewart, Kolasch & Birch, LLP

(57) ABSTRACT

An oil supply device of a scroll compressor includes a pumping unit mounted at a lower side of a rotating shaft and pumping oil stored at a lower portion of a casing according to rotation of the rotating shaft; an oil supply passage formed in a longitudinal direction of the rotating shaft and supplying oil pumped by the pumping unit to each friction portion; an oil channel formed at an upper surface of the main frame and connecting an oil groove formed at the upper surface of the main frame and a pocket formed at the center of the main frame; and an oil guide recess formed to connect the oil groove and the key hole formed at the main frame and guiding oil introduced into the oil groove to the key hole. By supplying oil to the key hole, abrasion between an oldham-ring key and the key hold is prevented and noise is reduced, enhancing reliability of the compressor.

7 Claims, 8 Drawing Sheets

OIL SUPPLY DEVICE OF SCROLL COMPRESSOR

BACKGROUND OF THE INVENTION

1. Field of the Invention

The present invention relates to a scroll compressor and, more particularly, to an oil supply device of a scroll compressor capable of reducing abrasion and a noise of a friction portion by supplying oil to an oldhamring key to perform a smooth lubricating operation on the rubbed portion, and thus enhancing reliability of a compressor.

2. Description of the Background Art

FIG. 1 is a sectional view of a scroll compressor in accordance with a conventional art.

The conventional scroll compressor includes: a casing 106 having a certain closed space, to which a suction pipe 102 for sucking a fluid and discharge pipe 104 for discharging a compressed fluid are connected, a driving unit 108 disposed at a lower portion of the casing 106 and generating a driving force; and a compressing unit 110 disposed at an upper portion of the casing 106 and connected to the driving unit 108 by a rotating shaft 112 to compress the fluid sucked into the suction pipe 102 according to rotation of the rotating shaft 112 and discharge it through the discharge pipe 104.

A main frame 114 for rotatably supporting the upper portion of the rotating shaft 112 and the compressing unit 110 is installed at the upper portion of the casing 106, and a lower frame 116 for rotatably supporting a lower portion of the rotating shaft 112 is installed at the lower portion of the casing.

The driving unit 108 includes a stator 122 fixed in a circumferential direction of the casing 106 and a rotor 124 disposed at an inner circumferential surface of the stator 122 and fixed at the rotating shaft 112. When power is applied to the stator 122, the rotor 124 is rotated according to interaction between the stator 122 and the rotor 124, rotating the rotating shaft 112.

The compressing unit 110 includes a fixed scroll 128 having a fixed wrap 126 in an involute shape and fixed at an upper portion of the casing 106, and a orbiting scroll 132 having an orbiting wrap 130 in the involute shape corresponding to the fixed wrap 126 to have a certain compression chamber 118 therebetween, orbitingly supported by the main frame 114, and orbiting when the rotating shaft 112 is rotated.

A discharge passage 136 is formed at the center of the fixed scroll 128 in order to discharge a fluid after being compressed in the compressing chamber 118 according to the interaction between the fixed wrap 126 and the orbiting wrap 130, and a check valve 138 is installed at an upper side of the discharge passage 136 in order to prevent backflow of discharged fluid.

A muffler 140 is mounted at an upper side of the fixed scroll 128 in order to reduce noise of a gas being discharged to the discharge passage 136, and an oldhamring 150 for preventing rotation of the orbiting scroll 132 is installed between the orbiting scroll 132 and the main frame 114.

A key home 160 is formed at intervals of 90° at an upper surface of the main frame 114, into which the oldhamring key of the oldhamring 150 is inserted.

FIG. 2 is a view of an upper surface of the main frame of the conventional scroll compressor and FIG. 3 is an enlarged view of a portion 'A' of FIG. 1.

The oil supply device includes a pumping unit 162 mounted at a lower side of the rotating shaft 112 and pumping oil stored at a lower portion of the casing 106 according to rotation of the rotating shaft 112; an oil supply passage 164 formed in a longitudinal direction at the rotating shaft 112 and supplying oil pumped by the pumping unit 162 to each friction portion; and n oil supply hole 166 formed at the main frame 114 and supplying oil from the oil supply passage 164 to a thrust bearing surface contacting between the orbiting scroll 132 and the main frame 114.

As for the oil supply hole 166, a first supply hole 168 is formed penetratingly in a horizontal direction at the main frame 114 and a second supply hole 170 is formed in a vertical direction at an upper surface of the main frame 114 so as to be connected with the first supply hole 168. An exposed portion of the first supply hole 168 is closed with rivet 172.

The conventional oil supply device constructed as described above operates as follows.

When power is applied to the stator 122, the rotor 124 is rotated according interaction between the stator 122 and the rotor 124 and the rotating shaft 112 fixed at the rotor 124 is rotated in a forward direction. Then, the orbiting scroll 132 is orbitingly moved according to the rotation of the rotating shaft 112 to interact with the fixed scroll 128 to compress the gas flowing into the compressing chamber 118. The compressed gas is introduced into the high pressure chamber 142 through the discharge passage 136, and then the gas introduced into the high pressure chamber is discharged externally through the discharge pipe 104.

When the compressor is driven, the oil supply device is driven to supply oil stored at the lower portion of the casing to each friction portion of the compressor, thereby making a lubricating operation.

In other words, when the rotating shaft is rotated, the pumping unit mounted at the lower end of the rotating shaft is operated to pump the oil stored at the lower portion of the casing. The pumped oil is delivered upwardly along the oil supply passage formed at the rotating shaft and supplied between the thrust bearing surface of the main frame and the thrust bearing surface of the orbiting scroll through the oil supply hole formed at the main frame, making a lubricating operation.

However, the oil supply device of the conventional scroll compressor has the following problems.

That is, when the oil supply hole is processed at the main frame, the first supply hole is formed in the horizontal direction, the second supply hoe is formed in the vertical direction, and then, the outer side of the first supply hole is riveted to be closed. Thus, its fabrication process is complicate and fabrication cost is high.

In addition, the oil supplied to the thrust bearing surfaces of the main frame and the orbiting scroll through the oil supply hole is not smoothly supplied to the key hole into which the oldhamring key is inserted, causing generation of abrasion and noise.

Moreover, the oil supplied to the thrust bearing surfaces of the main frame and the orbiting scroll through the oil supply hole cannot smoothly flow out, causing a problem that the supplied oil is retained.

SUMMARY OF THE INVENTION

Therefore, one object of the present invention is to provide an oil supply device of a scroll compressor capable of reducing a fabrication cost by simultaneously forming an oil channel at an upper surface of a main frame when the main frame is formed and thus removing an additional process for forming the oil channel.

Another object of the present invention is to provide an oil supply device of a scroll compressor capable of preventing abrasion between an oldhamring key and a key hole and reduce a noise by supplying oil to the oldhamring key hole.

To achieve these and other advantages and in accordance with the purpose of the present invention, as embodied and broadly described herein, there is provided an oil supply device of a scroll compressor including: a pumping unit mounted at a lower side of a rotating shaft and pumping oil stored at a lower portion of a casing according to rotation of the rotating shaft; an oil supply passage formed in a longitudinal direction of the rotating shaft and supplying oil pumped by the pumping unit to each friction portion; and an oil channel formed at an upper surface of the main frame and connecting an oil groove formed at the upper surface of the main frame and a pocket formed at the center of the main frame.

The oil channel is formed to make a right angle with a key hole formed at the main frame and simultaneously processed with the main frame when the main frame is processed.

To achieve the above objects, there is also provided an oil supply device of a scroll compressor including: a pumping unit mounted at a lower side of a rotating shaft and pumping oil stored at a lower portion of a casing according to rotation of the rotating shaft; an oil supply passage formed in a longitudinal direction of the rotating shaft and supplying oil pumped by the pumping unit to each friction portion; an oil channel formed at an upper surface of the main frame and connecting an oil groove formed at the upper surface of the main frame and a pocket formed at the center of the main frame; and an oil guide recess formed to connect the oil groove and the key hole formed at the main frame and guiding oil introduced into the oil groove to the key hole.

An entrance, of the oil guide recess, connected to the key hole has a width of less than 55% of the width of the key hole, and the oil guide recess is formed deeper than the depth of the oil groove.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An oil supply device of a scroll compressor in accordance with preferred embodiments of the present invention will now be described with reference to the accompanying drawings.

There can be several embodiments of the oil supply device of a scroll compressor, the most preferred one of which will be described.

Figure 1:
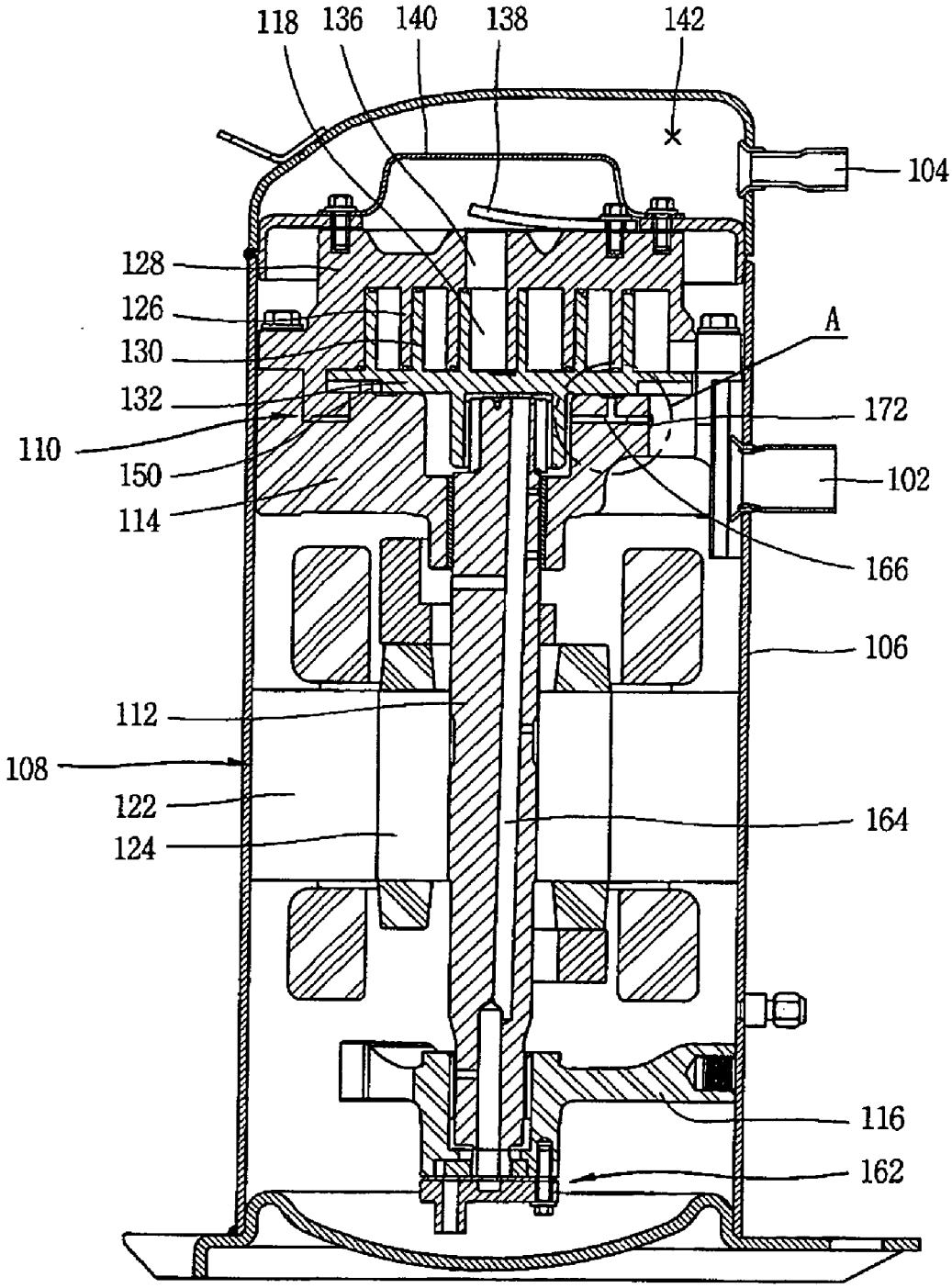
FIG. 1 CONVENTIONAL ART
FIG. 1 is a sectional view of a scroll compressor in accordance with a conventional art.
Figure 2:
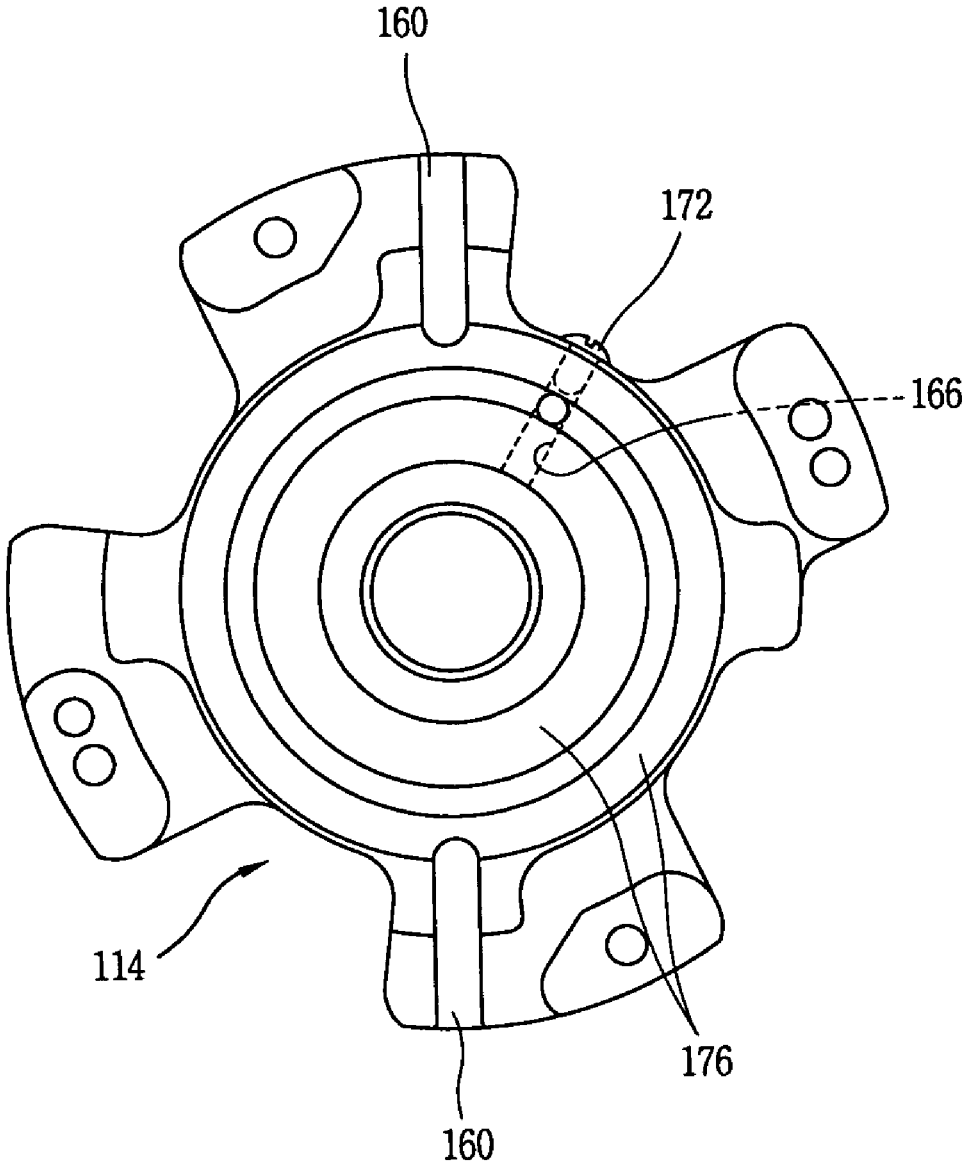
FIG. 2 CONVENTIONAL ART
FIG. 2 is a view of an upper surface of a main frame of a scroll compressor in accordance with the conventional art.
Figure 3:
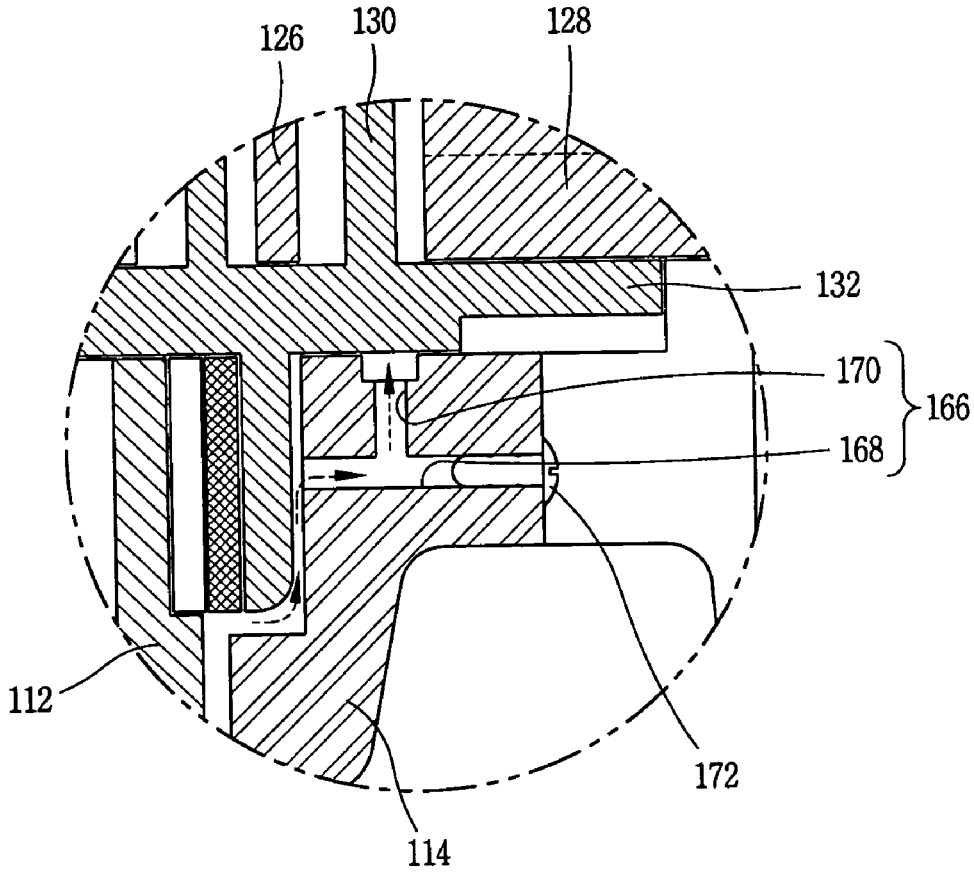
FIG. 3 CONVENTIONAL ART
FIG. 3 is an enlarged view of a portion 'A' of FIG. 1.
Figure 4:
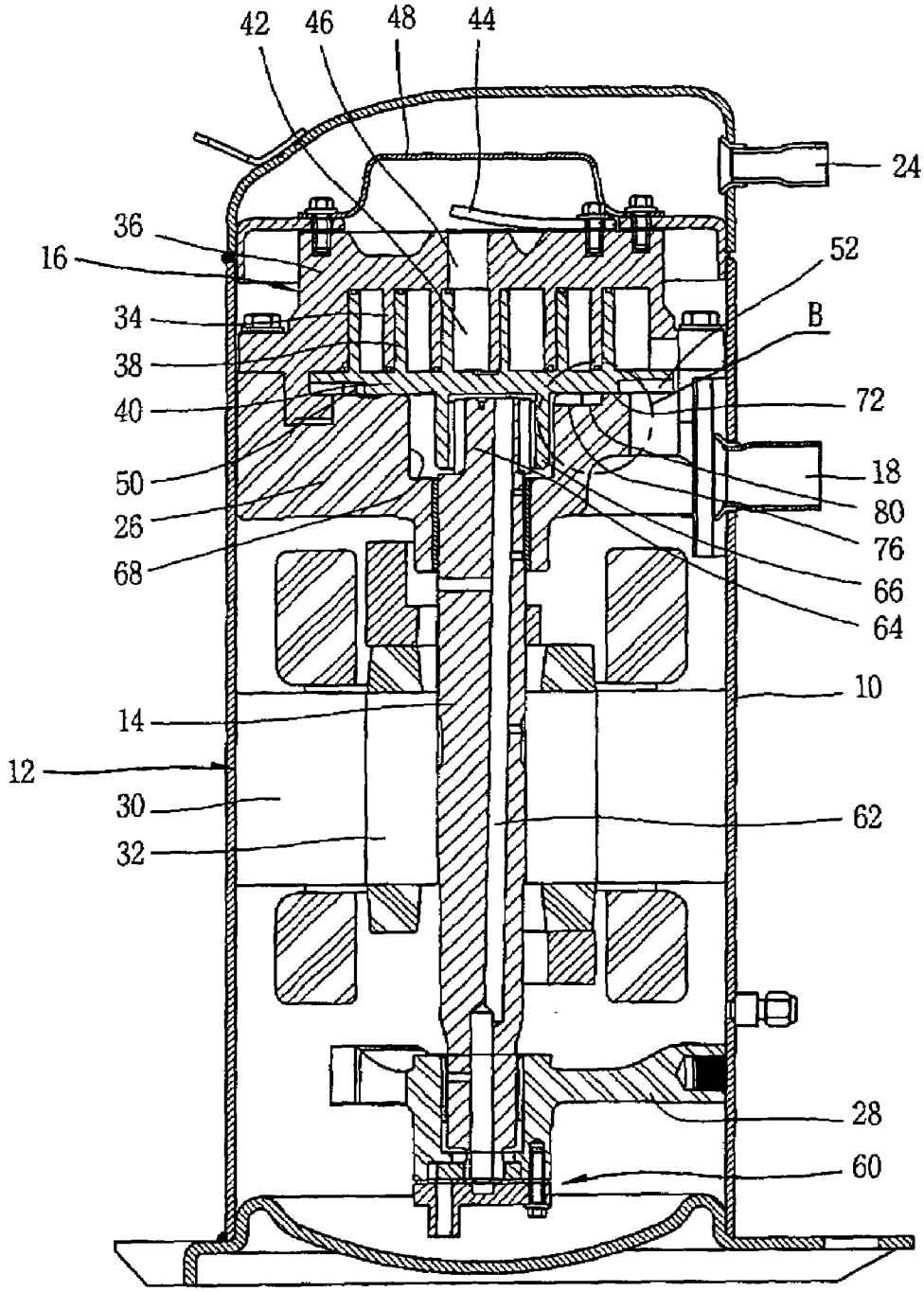
FIG. 4 is a sectional view of the scroll compressor in accordance with the present invention.
Figure 5:
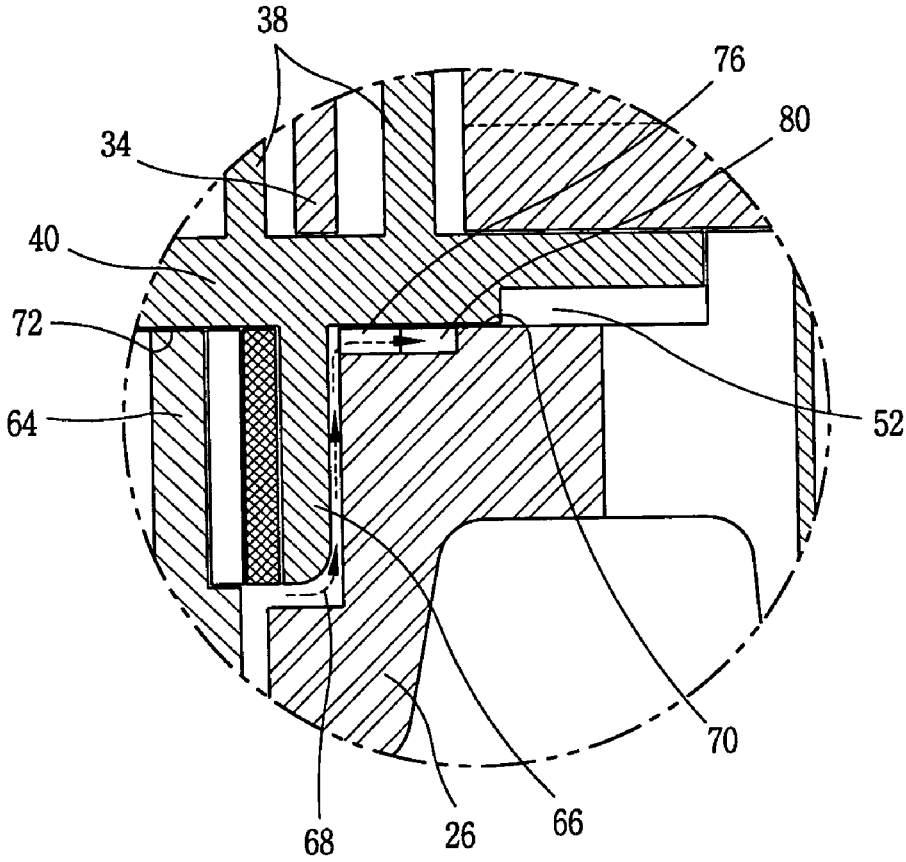
FIG. 5 is an enlarged view of a portion 'B' of FIG. 4.

FIG. 4 is a sectional view of the scroll compressor in accordance with the present invention.

A scroll compressor in accordance with the present invention includes: a casing 10 having a certain closed space; a driving motor 12 installed in the casing 10 and generating a driving force; a compression unit 16 connected with the driving motor 12 by a rotating shaft 14, and compressing a fluid and discharging it outwardly when the driving motor is driven; and an oil supply device for making a lubrication operation by supplying oil stored at a lower portion of the casing 10 to each friction portion.

A suction pipe 18 through which a gas is sucked and a discharge pipe 24 through which a compressed gas is discharged are connected to the casing 10. Inside the casing 10, there are provided a main frame 26 which rotatably supports the rotating shaft 14 and the compression unit 16, and a lower frame 28 which rotatably supports a lower end of the rotating shaft 14.

The driving motor 12 includes a stator 30 fixed at an inner circumferential surface of the casing 10 and a rotor 32 disposed at the inner circumferential surface of the stator 30 and fixed at the rotating shaft 14. Accordingly, when power is applied to the stator 30, the rotor 32 is rotated according to interaction between the stator 30 and the rotor 32, to thereby rotate the rotating shaft 14.

The compression unit 16 includes a fixed scroll 36 having an involute-shaped fixed vane 34 and fixed at an upper portion of the casing 10; an orbiting scroll 40 having an involute-shaped orbiting vane 38 corresponding to the fixed vane 34 so as to have the compressing chamber 42 therebetween, and orbitingly supported by the main frame 26 so as to make an orbiting movement when the rotating shaft 14 is rotated; and a muffler 48 fixed at an upper surface of the fixed scroll 36 and reduce a noise generated from the fluid compressed in the compressing chamber 42.

An exhaust hole 46 is formed at the center of the fixed scroll 36 in order to exhaust the gas compressed according to interaction between the fixed vane 34 and the orbiting vane 38 to the high pressure chamber 20.

A check valve 44 is installed at an upper side of the fixed scroll 36 in order to prevent backflow of the fluid by opening or closing the exhaust hole 46.

An oldhamring 50 for preventing rotation of the orbiting scroll 40 is installed between the orbiting scroll 40 and the main frame 26.

The oldhamring 50 is a ring with plane upper and lower surfaces with a certain thickness. One oldhamring key (not shown) is formed at the upper surface of the oldhamring 50 and inserted into the key hole 52 formed at the lower surface of the orbiting scroll. Another oldhamring key (not shown) is formed at the lower surface of the oldhamring 50 and inserted into the key hole 56 formed at the main frame 26.

Figure 6:
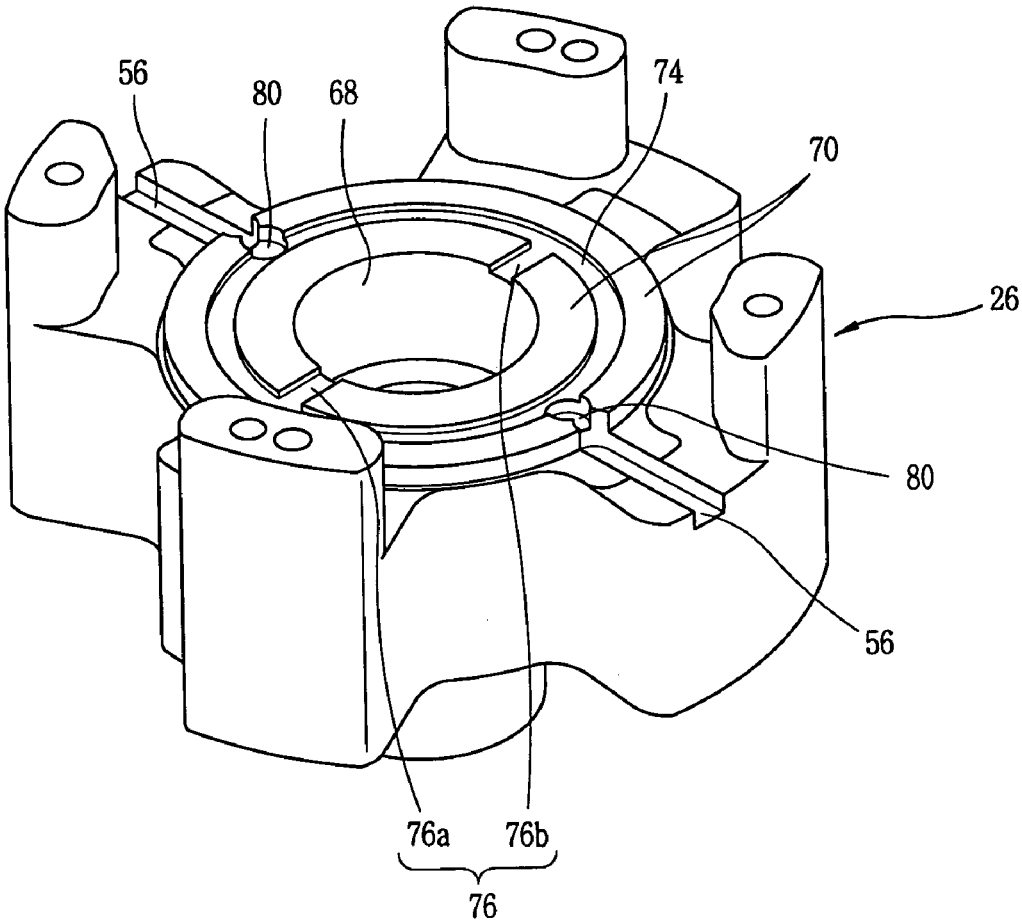
FIG. 6 is a perspective view of the main frame of the scroll compressor in accordance with one embodiment of the present invention.
Figure 7:
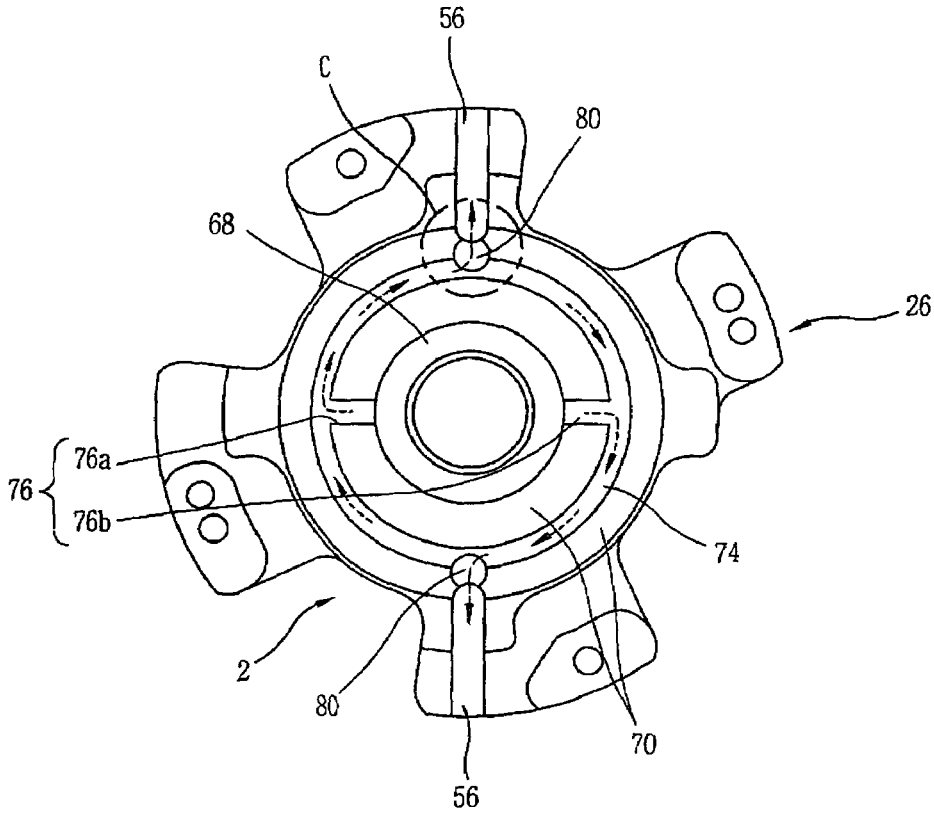
FIG. 7 is a view of an upper surface of the main frame of the scroll compressor in accordance with one embodiment of the present invention.
Figure 8:
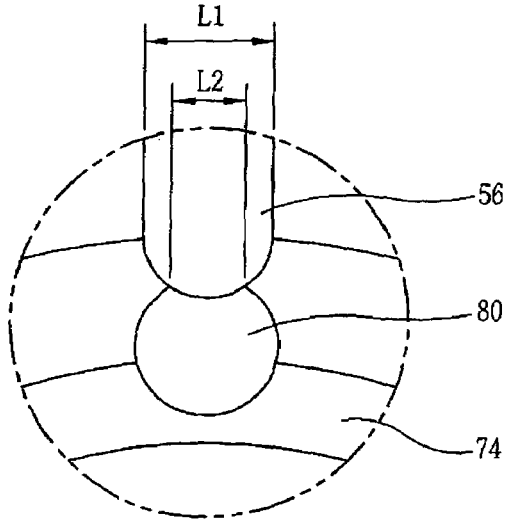
FIG. 8 is an enlarged view of a portion 'C' of FIG. 7.

FIG. 6 is a perspective view of the main frame of the scroll compressor in accordance with one embodiment of the present invention, FIG. 7 is a view of an upper surface of the main frame of the scroll compressor in accordance with one embodiment of the present invention, and FIG. 8 is an enlarged view of a portion 'C' of FIG. 7.

The main frame 26 includes a pocket 68 formed at its center, into which an eccentric part 64 formed at an upper end of the rotating shaft 16 and a boss 66 of the orbiting scroll 40 are inserted, a key hole 56 formed at both sides, into which the oldhamring key is inserted at 90° intervals and linearly moved, and a trust bearing surface 70 formed at its upper surface and being in contact with the orbiting scroll 40.

The orbiting scroll 40 includes the boss 66 formed at its lower side, into which the eccentric part 64 of the rotating shaft 16 is inserted, the key hole 52 into which the oldhamring key is inserted and linearly moved, and a trust bearing surface 72 formed at its lower surface and being in contact with the main frame 26.

The oil supply device includes a pumping unit 60 mounted at a lower side of the rotating shaft 14 and pumping oil stored at the lower portion of the casing 10 according to rotation of the rotating shaft 14; an oil supply passage 62 formed in a longitudinal direction at the rotating shaft 14 and supplying oil pumped by the pumping unit 60 to each friction portion; an oil groove 74 formed in a circumferential direction at the upper surface of the main frame 26; an oil channel 76 formed at the upper surface of the main frame 26 and connecting the pocket 68 of the main frame 26 and the oil groove 74 to supply oil from the pocket 68 to the oil groove 74; and an oil guide recess 80 formed between the oil groove 74 and the key hole 56 to guide oil from the oil groove 74 to the key hole 56.

The oil channel 76 is formed in a radial direction at the upper surface of the main frame 26, of which one end is positioned at the pocket 68 of the main frame 26 and the other end is positioned at the oil grove 74 to supply the oil from the pocket 68 to the oil groove 74.

The oil channel 76 makes a right angle with the key hole 56 and includes a first oil channel 76*a* positioned at an interval of 90° with the key hole 56 and a second oil channel 76*b* positioned at an interval of 180° with the first oil channel 76*a*.

The oil channel 76 is integrally processed when the main frame 26 is processed, so that an additional processing is not necessary to process the oil channel 76.

The oil guide recess 80 is a circular recess formed at the upper surface of the main frame 26, of which one side is connected to the oil groove 74 and the other side is connected to the key hole 56 to supply oil from the oil groove 74 to the key hole 56.

The oil guide recess 80 is integrally processed when the main frame 26 is processed, so that an additional process for processing the oil guide recess 80 is not necessary.

As shown in FIG. 8, as for the oil guide recess 80, the width (L2) of the entrance connected to the key hole 56 is less than 55% of the width (L1) of the key hole to prevent a large amount of oil from being supplied to the key hole 56 at one time. In addition, the oil guide recess 80 is formed deeper than the oil groove 74 to smoothly supply oil to the key hole 56. Namely, it is preferred that the oil groove recess 80 has a depth of 2 mm or larger.

Figure 9:
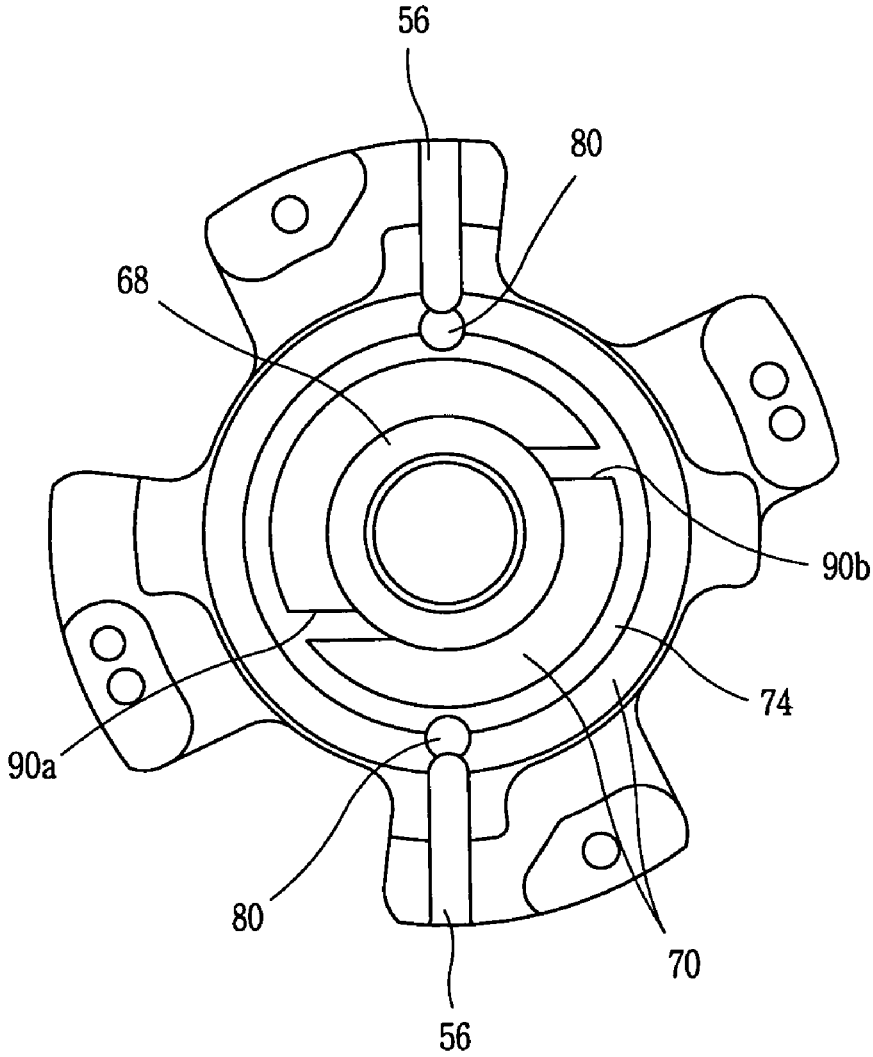
FIG. 9 is a view of an upper surface of the main frame in accordance with another embodiment of the present invention.

FIG. 9 is a view of an upper surface of the main frame in accordance with another embodiment of the present invention.

A main frame in accordance with another embodiment of the present invention has the same structures as the main frame of the first embodiment, except for an oil channel.

That is, in the second embodiment of the present invention, a pair of oil channels 90*a* and 90*b* are disposed at intervals of 180° at the upper surface of the main frame 26 and have a different phase. Namely, the oil channels 90*a* and 90*b* are formed eccentric toward the direction in which the rotating shaft 16 is rotated so as to smoothly discharge oil.

The scroll compressor constructed as described above operates as follows.

In case that the compressor is normally operated, when power is applied to the driving motor 12, the rotating shaft 14 is rotated. Then, the orbiting scroll 40 is orbitingly moved according to rotation of the rotating shaft 14 to compress a fluid sucked into the compressing chamber 42 according to interaction with the fixed scroll 36. The compressed fluid is introduced into the muffler 48 through the exhaust hole 46 and then discharged through the discharge pipe 24.

During the operation of the compressor, the oil supply device is operated according to rotation of the rotating shaft 14 to supply oil to each friction portion to make a lubricating operation.

Operation of the oil supply device will be described in detail as follows.

As the pumping unit 60 is operated according to rotation of the rotating shaft 14 to pump oil stored at the lower portion of the casing 10, and the pumped oil is supplied into the pocket 68 of the main frame 26 through the oil supply passage 62 formed at the rotating shaft 14.

The oil supplied to the pocket 68 is rotated in the direction that the rotating shaft 14 is rotated and then supplied to the oil groove 74 through the oil channel 76 formed at the upper surface of the main frame 26. The oil is then supplied from the oil groove 74 to between the thrust bearing surface 70 of the main frame 26 and the thrust bearing surface 72 of the orbiting scroll 40, making a lubricating operation therein.

Oil remaining after being supplied to the oil groove 74 and performing the lubricating operation between the thrust bearing surfaces 70 and 72 is supplied to the key hole 56 through the oil guide recess 80 to make a lubricating operation between the oldhamring key of the oldhamring 50 and the key hole 56.

At this time, since the oil guide recess 80 has the width (L2) smaller by 55% than the width (L1) of the key hole 56, so that a large amount of oil cannot flow into the key hole 56.

As so far described, the scroll compressor in accordance with the present invention has many advantages as follows.

That is, since the oil channel is formed at the upper surface of the main frame to connect the pocket and the oil groove and processed together with the main frame simultaneously, a fabrication cost can be reduced. And, since oil is smoothly supplied to the thrust bearing surfaces of the main frame and the orbiting scroll, reliability of the compressor can be enhanced.

In addition, since the oil guide recess is formed between the key hold into which the oldhamring key is inserted and the oil groove to supply oil from the oil groove to the key hole, a noise and abrasion between the key hole and the oldhamring key can be reduced, and thus, reliability of the compressor is also enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor comprising:

a casing;

a main frame located within the casing;

a fixed scroll and an orbiting scroll movable with respect to the fixed scroll;

a rotating shaft rotatably supported by the main frame; and an oil supply device including:

a pumping unit mounted at a lower side of the rotating shaft and pumping oil stored at a lower portion of a casing according to rotation of the rotating shaft;

an oil supply passage formed in a longitudinal direction of the rotating shaft and supplying oil pumped by the pumping unit to at least one friction portion;

an oil channel formed at an upper surface of the main frame and connecting an oil groove formed at the upper surface of the main frame and a pocket formed at the center of the main frame; and an oil guide recess formed to connect the oil groove and a key hole formed at the main frame and guiding oil introduced into the oil groove to the key hole.

2. The scroll compressor of claim 1, wherein the oil channel extends radially orthongonal to the key hole formed at the main frame.

3. The scroll compressor of claim 2, wherein the oil channel includes a first oil channel formed at an interval of 90° with the key hole formed at the main frame and a second oil channel positioned on the same straight line with the first channel and formed at an interval of 90° with the key hole.

4. The scroll compressor of claim 1, wherein an entrance, of the oil guide recess, connected to the key hole has a width of less than 55% of the width of the key hole.

5. The scroll compressor of claim 1, wherein the oil guide recess is formed deeper than the depth of the oil groove.

6. The scroll compressor of claim 1, wherein the depth of the oil guide recess is at least 2 mm or larger.

7. The scroll compressor of claim 1, wherein the oil channel includes a pair of oil channels which are disposed at an interval of 180° with a different phase.

* * * * *